United States Patent [19]

Jones et al.

[11] 4,255,928

[45] Mar. 17, 1981

[54] SWINGABLE RAIN COVER FOR VERTICAL EXHAUST PIPES WITH STOP MEANS

[75] Inventors: W. Richard Jones, North Barrington; Albert Hartman, Jr., Hampshire; Earl Conrad, Lake in the Hills; Harry J. Kraig, Barrington Hills, all of Ill.

[73] Assignee: Mercury Metal Products, Schaumburg, Ill.

[21] Appl. No.: 967,990

[22] Filed: Dec. 11, 9178

[51] Int. Cl.[3] ..... F01N 7/00; F23L 17/02

[52] U.S. Cl. ..... 60/324; 98/59; 98/122

[58] Field of Search ..... 60/324; 98/59, 122; 110/63, 217, 331, 173 R; 137/527.2

[56] References Cited

U.S. PATENT DOCUMENTS

| | | | |
|---|---|---|---|
| 2,694,358 | 11/1954 | Taylor | 98/59 |
| 2,749,832 | 6/1956 | Harmon | 98/59 |
| 2,983,216 | 5/1961 | Stade et al. | 98/59 |
| 3,274,917 | 9/1966 | Tolbert | 98/59 |
| 3,523,499 | 8/1970 | Bauerschmidt | 98/59 |
| 3,667,260 | 6/1972 | Foote | 98/59 |
| 3,791,282 | 2/1974 | McElhose et al. | 98/59 |
| 4,059,045 | 11/1977 | McClain | 98/122 |

*Primary Examiner*—Carlton R. Croyle
*Assistant Examiner*—Rae Cronmiller
*Attorney, Agent, or Firm*—Silverman, Cass & Singer, Ltd.

[57] ABSTRACT

A cover assembly is provided to be secured to the upper end of an exhaust pipe of an internal combustion engine maintained outdoors in such a manner such that a cap forming part of the assembly will cover the end of the exhaust pipe when the engine is quiescent. When exhaust gases exert pressure in the pipe during operation of the engine the cap will be raised against gravity off the end of the pipe to permit the gases to escape. The movement of the cap between open and closed positions is a rocking movement about a pivot and normally results in considerable clatter as the parts strike metal. Means are provided by the invention to reduce the clatter.

10 Claims, 9 Drawing Figures

SWINGABLE RAIN COVER FOR VERTICAL EXHAUST PIPES WITH STOP MEANS

BACKGROUND OF THE INVENTION

This invention is an improvement over the structures of U.S. Pat. Nos. 2,983,216 and 4,059,045 which are incorporated herein by reference.

The invention relates to protective caps or rain covers for the open ends of upright exhaust pipes of internal combustion engines. Such covers are mounted for rocking movement on exhaust stacks to prevent entry of rain, insects, dust and the like when the engines are not operating. More particuarly, the invention relates to means for preventing, or at least reducing, the loud noises associated with the opening and closing of the covers.

Among the known prior art directed to attempting to reduce the noise of rain covers is a "Weather Cap Construction" disclosed in U.S. Pat. No. 3,523,499. The present invention distinguishes over this patent by virtue of a novel combination with a rain cover of improved stop means and bumpers as set forth hereinafter in the body of the specification.

The structure of the prior art U.S. Pat. No. 3,523,499 is complex and expensive in that in order to make the combination of the fulcrum arm and the clamping structure out of an integral member of sheet metal it is necessary to utilize sheet metal that has a relatively wide dimension. The fulcrum arm and clamp structure must either be stamped from blanks which are individually cut or, if stamped in a progressive die on a continuous basis must be made from strip material that is wider than the width of either the clamp portion or the leg portion. In either case the device is expensive to manufacture.

The invention herein utilizes a structure in which the clamp portion and the pivot support are formed of strip material whereby not only is there practically no scrap during fabrication, but the forming and shaping can be effected in bending, punching, welding and the like fixtures rather than in expensive dies as required for the said U.S. Pat. No. 3,523,499.

Still another problem with prior art devices like those of the said U.S. Pat. No. 3,523,499 is that they occupy large space. The vertical profile of the exhaust stack of a vehicle upon which they are installed is increased and they require larger containers for shipment and storage. The invention on the other hand, by virtue of its novel structure, provides a very low profile. This is achieved by making the clamp and arm support out of strap material, having the pivot and clamping fastener in horizontal alignment and by a major portion of the counterweight vane below the clamping means rather than above it.

A further problem which is solved by the invention is the wearing out of plastic bumper means. According to the invention, the bumper means are readily removable and replaceable in one case and prevented from extrusion flow in another case.

SUMMARY OF THE INVENTION

Rain covers or rain caps according to the invention comprise a clamp formed of two metal straps which are secured together face to face for a portion of their combined length and formed in a circle and adapted to fit around an exhaust stack at a second portion of their combined length. Each metal strap has an extension, or ear, at the end of the second portion which is perforated cooperatively to receive a bolt or other fastener to secure the clamp to an exhaust stack. A balance arm, bearing a dish-like cover, is pivotally supported by the clamp at a location in horizontal alignment with the fastener, so that when the clamp is mounted on a stack the balance arm will swing between one position in which the weight of the cover causes it to close the upper end of the exhaust stack, and another position in which exhaust gases force the cover to swing up off the stack. Stop means are provided on the balance arm member and plastic bumper means are provided on the clamp member. The stop means and the bumper means are placed so that, as the cover opens and closes, the stop means and the bumper means will strike each other, preventing parts of the balance arm member from directly striking either the end of the exhaust pipe or the clamp member thereby reducing the clatter which normally occurs as the cover opens and closes.

DESCRIPTION OF THE PREFERRED EMBODIMENTS

Figure 1:
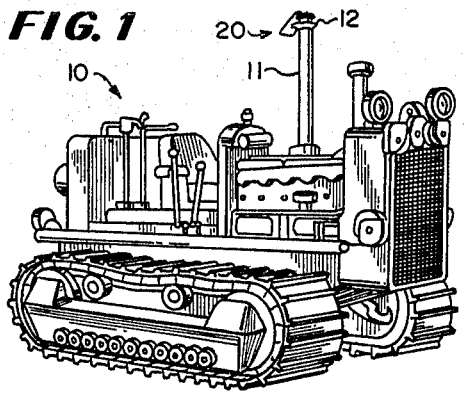
FIG. 1 is a perspective view of a tractor wherein a protective cover assembly embodying the invention is shown installed in a closed position upon the upstanding exhaust stack.

Turning now to FIG. 1, there is shown a rain cover assembly or device 20 according to the invention which is secured by a support or clamp member 12 to an upstanding exhaust stack or pipe 11 of a heavy duty vehicle 10. The rain cover is shown closed, in the position it will be held by gravity when the vehicle is inoperative and no exhaust gases are being expelled from the exhaust stack 11. When exhaust gases exert pressure in the column the rain cover will swing open, permitting the gas to escape.

Figure 2:
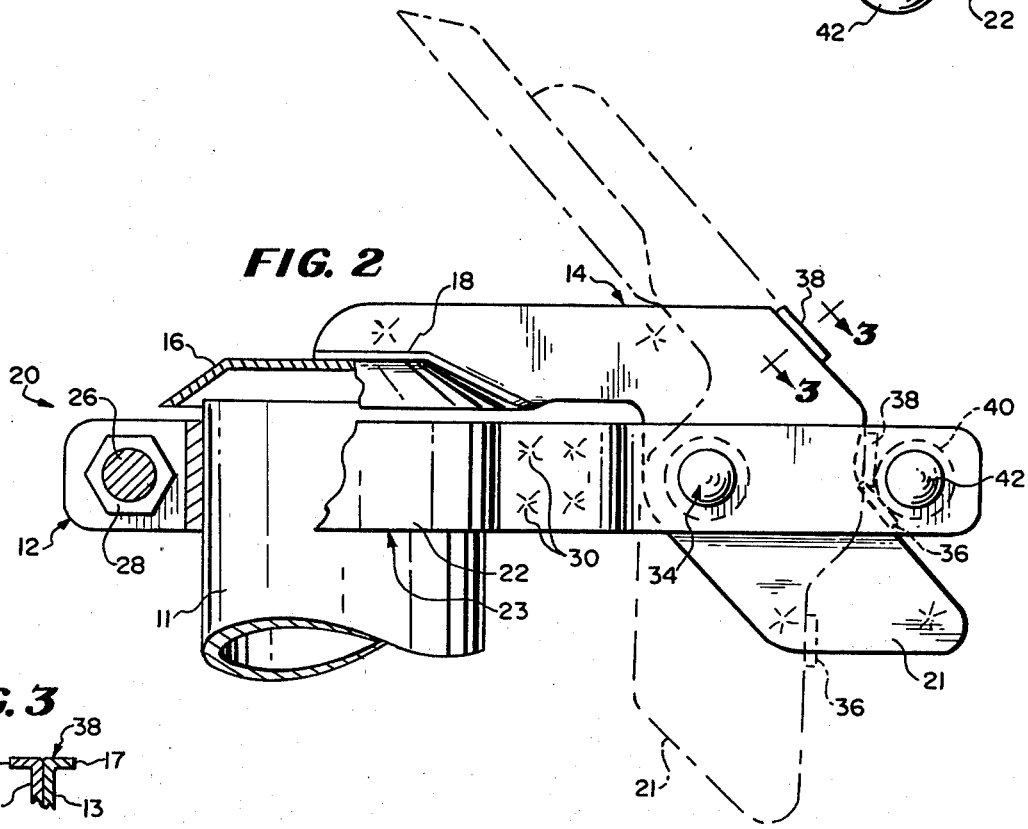
FIG. 2 is a side elevational view with parts broken away and showing the protective cover of the invention installed on an exhaust stack.

As shown in FIG. 2, the rain cover assembly 20 includes a support or clamp member 12, a balance arm 14 and a dish shaped cover member 16 secured to one end of the balance arm 14 and the formed flange 18 as by welding or other means indicated at 17. The balance arm 14 is preferably made of two sheet metal stampings 13 and 15 of mirror configuration, welded face to face, the flanges 18 being integral with the forward (left) ends thereof.

The support or clamp member 12 comprises two sheet metal bands or straps 22 and 23 which are formed and shaped from simple strip steel, both being of substantially the same length and connected together near their midpoints by welding or other means as indicated at 30. One end of this assembly provides the clamping function by suitable means to enable the device 20 to be secured to the engine exhaust stack 11 and the other end provides the support for pivoting the balance arm 14 and also the mounting for the bumper means.

At the left hand end of the support or clamp member 12, the two bands are apertured to receive the bolt 26 and its nut 28, the bands having outwardly bowed bights adjacent the ends as shown at 23 to enable the clamp member to straddle and be secured upon the stack 11 in a clamping action.

At the right hand end of the support or clamp member 12, beyond the welded together portions of the straps 22 and 23, the straps spread and are spaced apart to form a bifurcated structure 31 which mounts the pivot 34 and the bumper 40.

The pivot means 34 may be conventional or may comprise the pivot means described in detail in either of U.S. Pat. Nos. 2,983,216 or 4,059,045. The balance arm 14 includes a counterweight vane 21 which passes between the two parts of the bifurcated structure 31 in its movement which, as seen in FIG. 2 consists of swinging between the solid line and phantom outlines. In the solid line outlines there is no exhaust gas being emitted from the stack 11 and the weight of the cover member 16 brings it down upon the free end of the stack. As seen, the upper end of the stack 11 is shown spaced from the inside of the cover member 16 so that if this situation obtains there will be no noisy clatter due to the inside of the cover member 16 striking the exhaust stack. Even during operation of the engine the swinging movement may permit the solid line condition to be achieved between bursts of exhaust gas, especially in low speed engines. In the phantom outlines, the pressure of exhaust gases and the weight of the vane 21 cause the swinging to the position shown. In this position, the vane is arranged, according to the invention, to come into engagement with a resilient or shock absorbing bumper rather than strike metal.

Figure 5:
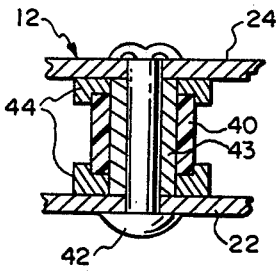
FIG. 5 is a fragmentary cross sectional view taken through lines 5—5 of FIG. 4 and in the indicated direction, illustrating a bumper bushing of the invention.
Figure 4:
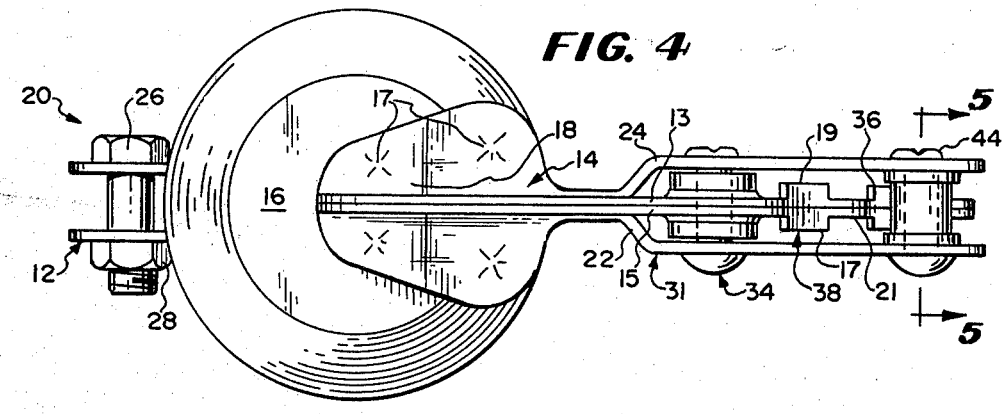
FIG. 4 is a top plan view of the protective cover assembly of FIG. 2.

The bumper 40 is a bushing of synthetic resin such as tetrafluorethylene which is not readily effected by heat that is mounted on a suitable rivet 42 extending between the bifurcated straps 22 and 24 being held in place by the cup-like washers 44 on a metal bushing 43. The bushing 40 may be simply formed as a cylindrical member that extends the full length of the space between the straps 22 and 24 at the right hand end of the clamp member 12, if desired, but there are advantages to the structure described in connection with FIG. 5. The constant striking of the bumper 40 tends to cause it to distort and flow, and the structure of FIG. 4 with the cup-like washers 44 tends to confine the bumper.

Figure 3:
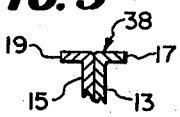
FIG. 3 is a fragmentary cross sectional view taken through line 3—3 of FIG. 2 and in the direction indicated.

The balance arm 14 has tabs or flanges bent outwardly from the metal members 13 and 15 which form the balance arm, these being shown in FIG. 3, for example at 17 and 19. These small tabs together form the stop means which has been mentioned, there being two such formations formed on the balance arm 14, one at 36 and one at 38. When the weight of the cover member 16 is dominant, as when the engine is not running, the balance arm 14 is in the solid line position of FIG. 2 and the stop means 36 engages the bumper 40 at a lateral side thereof, limiting the movement of the balance arm in a counterclockwise direction around the pivot 34. This is chosen with respect to the position that the device 20 is clamped to the stack 11 in such a manner that there is the clearance between the inside of the cover member 16 and the stack end that is illustrated in FIG. 2.

When the engine is running and the exhaust gases blow the balance arm upward and force rotation thereof around the pivot in a clockwise direction as viewed in FIG. 2, this movement is limited by the stop means 38 engaging the bumper 40 as shown in the broken lines of FIG. 2. The counterweight vane 21 is now substantially below the upper end of the stack 11.

It is seen that the bolt 26, the pivot 34 and the axis of the bumper 40 are all aligned horizontally so that it is a single matter to manufacture the support member 12 out of strips of metal that are formed in fixtures, welded and punched to receive the bolt 26, the bolt supporting the pivot 34 (not shown) and the bolt 42 which supports the bumper 40. No complex dies are needed. Further the profile of the device is low, carrying structure very little above the upper extent of the stack 11.

In FIGS. 6 through 9 there is illustrated another form of the invention in which there is a replaceable bumper member instead of one which is permanently or semi-permanently affixed as a bushing. Also the structure is somewhat simplified.

The reference character 200 designated generally the rain cover of FIGS. 6 to 9 which is adapted to be clamped to an engine exhaust stack 11 in the same manner as the device 20 previously described. In the device 20, again the support member 212 is formed out of a pair of mirror configuration straps 222 and 224 of sheet metal that are easy to fabricate. The clamp member 212 has the ears or tab ends 214 formed at the left hand end of each of the straps 222 and 224 respectively, these being perforated to provide for the engagement of a bolt and nut 216 or other fastening means. The two straps 222 and 224 are welded together near their centers at 218 permanently to secure the straps to one another. Between the welded section and the ears 214 the straps are outwardly bowed at 226 to provide a pair of bights forming a clamping section to enable securement of the device to the stack 11 as described.

Figure 8:
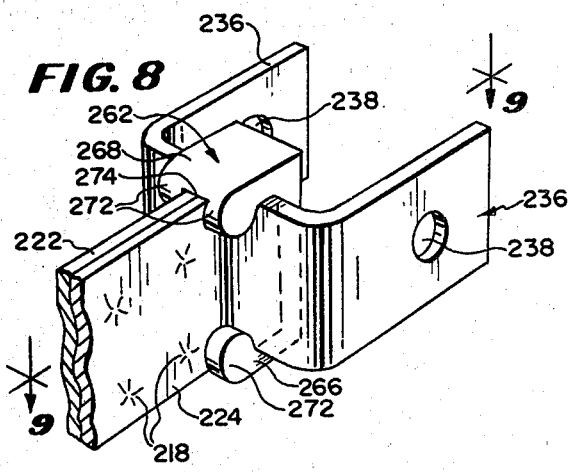
FIG. 8 is a fragmentary perspective view of a portion of the rain cover device of FIG. 6 showing the manner in which the bumper means are installed.
Figure 9:
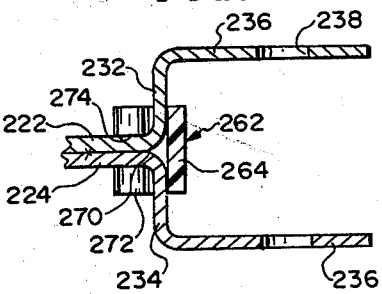
FIG. 9 is a horizontal sectional view taken generally along the line 9—9 of FIG. 8 and in the indicated direction.

At the right hand end of the support member 212 the free ends of the straps 222 and 224 are first bent outwardly at approximate right angles as indicated at 232 and 234 and then parallel to one another to provide the spaced parallel bifurcated section 236 as best seen in FIGS. 8 and 9. The bifurcated section 236 is perforated as shown at 238 in FIG. 8 to receive the rivet or bolt which secures the pivot device 240 that mounts the balance arm 242.

Figure 6:
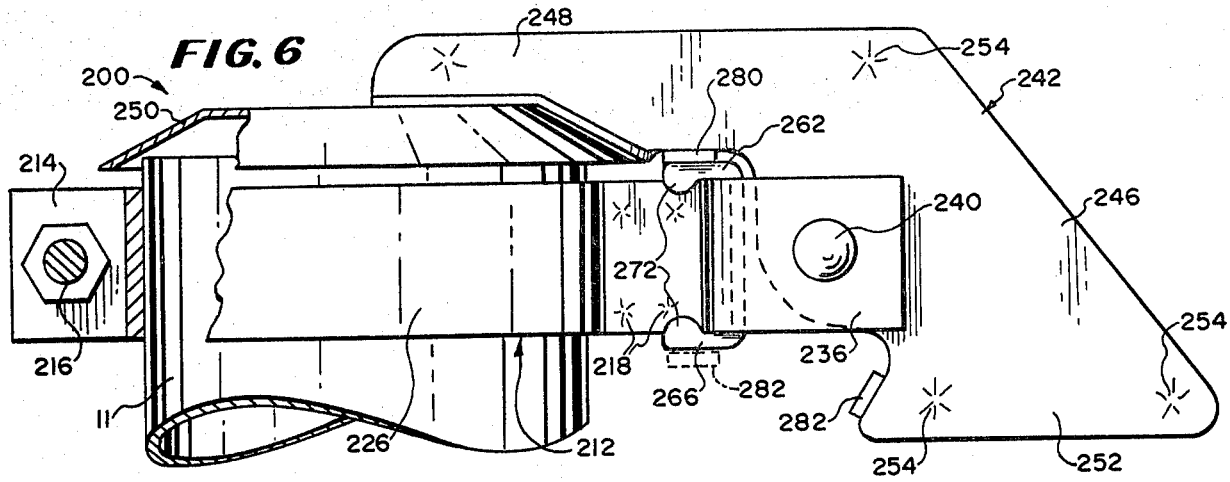
FIG. 6 is a view similar to that of FIG. 2 but of a modified form of the invention.
Figure 7:
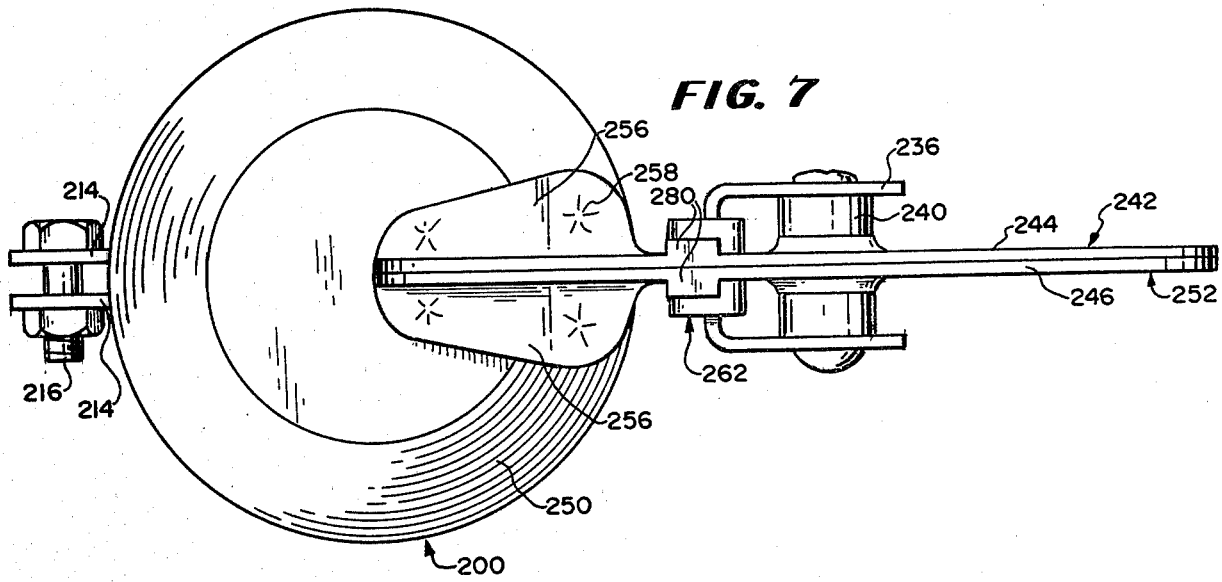
FIG. 7 is a top plan view of the rain cover device of FIG. 6.

The balance arm 242 and pivot 240 are only shown in FIGS. 6 and 7, the pivot being conventional or of the structure of the two incorporated patents, its purpose being to permit free rocking of the balance arm 242. The balance arm 242 is made out of a pair of identical sheet metal stampings 244 and 246 forming a front nose 248 that carries the cover member 250 and a rear counterweight vane 252. The two stampings 244 and 246 are welded together face to face at several locations such as shown at 254. Integral flanges 256 bent outwardly from the stampings 244 and 246 are welded to the top of the cover member 250 as indicated at 258.

The cover member 250 is of shallow dish-like inverted form and it is intended to engage over the upper end of the stack 11 without touching the same in the condition that the engine of which the stack 11 is the exhaust pipe is not running. This is the condition shown in FIG. 6. The weight of the cover member 250 and the front end of the balance arm 242 on the left hand side of the pivot point 240 is greater than the weight of the vane 252 so that the position of FIG. 6 is assumed by gravity. The limitation on the movement to this position and no further is brought about by the bumper means to be described.

When the engine of the stack 11 is running, exhaust gases will blow the cover member 250 off the stack 11 and cause it to rock in a clockwise direction about the pivot 240. This movement is also limited by the bumper means.

At the location along the clamp member or assembly 212 where the straps 222 and 224 separate into the right angle bends 232 and 234 there is engaged a removable bumper member 262 which is formed of a resilient material such as tetrafluorethylene. It may be molded as an integral member or fabricated. The bumper member 262 is of channel configuration, there being a back or base portion 264 and two arm parts 266 and 268. Each of the arm parts 266 and 268 is engaged over the junction 270 of the two straps 222 and 224 where they are welded together and where they are bent apart. This is best seen in the view of FIG. 9. The base portion 264 is engaged against the right hand face of the junction 270 and is located in the bifurcated section 236. Thus the arm 268 has a flat surface facing upward and the arm 266 has a flat surface facing downward.

Since bumper member 262 is of resilient material it is easily pressed onto the junction 270 or pulled off the junction 270. To assist in holding it in place, the arms 266 and 268 have rounded projections such as shown at 272 which help pilot the bumper member 262 onto the rear of the junction when it is installed and assist in its removal, these projections extending a slight distance below the upper edge of the support assembly 212 and a slight distance above the bottom edge of the support member or assembly 212. The projections of each arm do not extend fully across the bumper member 262 but leave a space between them which forms a groove at the top and bottom thereof to receive the welded portion of the clamp member 212 as shown at 274 in FIG. 8.

The movement of the balance arm 242 is limited by the bumper member 262 in cooperation with stop means that are provided on the balance arm. Tabs integral with the stampings forming the balance arm 242 are bent outwardly from the balance arm at 280 and at 282, the former being located to the right of the cover member 250 in FIG. 2 and the latter being located at the front edge of the vane 252. These tabs comprise the stop means mentioned.

Movement in a rocking motion around the pivot 240 in a counterclockwise direction is limited by the stop means 280 coming into engagement with the upper face of the arm 268. At this point of the movement which is represented by the solid lines of FIG. 2, the cover member 250 is suspended above the stack 11 although substantially closing the same off and does not touch the same. Movement in a rocking movement which is clockwise around the pivot 240 is limited by the stop means 282 coming into engagement with the lower face of the arm 266. This is shown by the broken line position of the stop means 282 in FIG. 6.

The rain cover device 200 is similar to the device 20 in that the clamp member 212 is made out of strap members with the pivot 240, the fastening means 216 and the bumper means 262 are substantially aligned. This gives the device low profile on the stack, makes it economical to manufacture and simple to install. The vane 252 extends below the top of the stack 11.

Both of the structures 20 and 200 provide a rain cover assembly which is easily installed, simple to manufacture and which substantially reduces the clatter and noise which has been so objectionable in this type of device in the past.

Variations are capable of being made without departing from the spirit or scope of the invention as defined in the appended claims.

What it is desired to secure by Letters Patent of the United States is:

1. A gravity actuated protective cover device adapted to be secured upon the upstanding exhaust stack of an internal combustion engine to prevent entry of extraneous matter therein during the inoperative condition of the engine and comprising:

A. a support member adapted to be secured to the exhaust stack and having a pivot structure and resilient bumper means mounted thereon, the support member having a clamping formation to straddle and be clamped to the exhaust stack which includes adjustable fastening means, said support member being formed of a pair of metal straps of generally mirror construction connected face to face, the pivot structure, bumper means and fastening means being generally aligned horizontally when the support member is installed on a stack, wherein the bumper means are disposed on said support member between the pivot structure and the fastening means, B. a balance arm mounted on said pivot structure for rocking movement about said pivot structure in a vertical plane, the balance arm having a cover member connected to the front and thereof and a counterweight vane, the vane and cover member being on opposite sides of the pivot structure, the balance arm being adapted for said rocking movement between two positions, one of which is with the cover member disposed engaged over the end of the exhaust stack but without touching the same, the other position being with the cover member substantially rotated away from the stack, C. the balance arm being heavier on the cover member side of the pivot than on the vane side of the pivot so that the normal condition of the balance arm is with the cover member in the first of said positions when the engine is not operating, D. the balance arm having a pair of stop members on an edge thereof, the stop members being equally spaced from the pivot means but disposed at an angle relative to one another and said pivot means, E. the straps having portions thereof spaced apart to provide a bifurcated portion, the pivot being located in the bifurcated portion, F. resilient bumper means disposed at said bifurcated portion and arranged in the path of movement of the stop members whereby to limit the said rocking movement and prevent engagement of the balance arm with any other part of the cover device on the stack end.

2. A gravity actuated protective cover device adapted to be secured upon the upstanding exhaust stack of an internal combustion engine to prevent entry of extraneous matter therein during the inoperative condition of the engine and comprising:

A. a support member adapted to be secured to the exhaust stack and having a pivot structure and resilient bumper means mounted thereon, the support member having a clamping formation to straddle and be clamped to the exhaust stack which includes adjustable fastening means, said support member being formed of a pair of metal straps of generally mirror construction connected face to face, the pivot structure, bumper means and fastening means being generally aligned horizontally when the support member is installed on a stack, wherein the pivot structure is disposed on said support member between the fastening means and the bumper means, B. a balance arm mounted on said pivot structure for rocking movement about said pivot structure in a vertical plane, the balance arm having a cover member connected to the front end thereof and a counterweight vane, the vane and cover member being on opposite sides of the pivot structure, the balance arm being adapted for said rocking movement between two positions, one of which is with the cover member disposed engaged over the end of the exhaust stack but without touching the same, the other position being with the cover member substantially rotated away from the stack, C. the balance arm being heavier on the cover member side of the pivot than on the vane side of the pivot so that the normal condition of the balance arm is with the cover member in the first of said positions when the engine is not operating, D. the balance arm having a pair of stop members on an edge thereof, the stop members being equally spaced from the pivot means but disposed at an angle relative to one another and said pivot means, E. the straps having portions thereof spaced apart to provide a bifurcated portion, the pivot being located in the bifurcated portion, F. resilient bumper means disposed at said bifurcated portion and arranged in the path of movement of the stop members whereby to limit the said rocking movement and prevent engagement of the balance arm with any other part of the cover device or the stack end.

3. The cover device as claimed in claim 1 in which the bumper means comprise a channel shaped plastic member having a base and an upper and lower arm, there being a bend in each of the straps at one end of the bifurcated portion and the plastic member being mounted to said bends and disposed so that the stop members will engage the upper and lower arms respectively to effect the limiting of said rocking movement.

4. The cover device as claimed in claim 3 in which at least the vane of the balance arm is made out of stamped sheet metal members connected together face to face and defining a plate-like structure in the plane of rocking movement of the balance arm, the stop members comprising integral tabs bent from the said sheet metal members.

5. The cover device as claimed in claim 3 in which the straps have a formation where they are connected face to face at said juncture opposite said bends and the plastic member is configured so that the arms engage over the face to face connected formation and the base engages the bends behind said formation.

6. The cover device as claimed in claim 5 in which the arms have end formations straddling the face to face formation and spaced apart a distance less than the width of said formation whereby the arms must be spaced apart to effect instatlation or removal of said plastic member relative to said support member.

7. The cover device as claimed in claim 2 in which the bumper means comprise a plastic bushing extending between the straps at the bifurcated section in the paths of the stop members during their rotation whereby to engage said stop members respectively and effect the limiting of said rocking movement.

8. The cover device as claimed in claim 7 in which at least the vane of the balance arm is made out of stamped sheet metal members connected face to face and defining a plate-like structure in the plane of rocking movement of the balance arm, the stop members comprising integral tabs bent from the said sheet metal members.

9. The cover device as claimed in claim 8 in which the tabs are located on the edge of the vane remote from the cover member.

10. The cover device as claimed in claim 4 in which the tabs are located on the edge of the vane nearest said cover member.

* * * * *